US005323738A

United States Patent [19]

Morse

[11] Patent Number: 5,323,738

[45] Date of Patent: Jun. 28, 1994

[54] TWO-CYCLE, ROTARY, RECIPROCATING PISTON ENGINE

[76] Inventor: Jonathan E. Morse, 3409 N. Old Stage Rd., Mt. Shasta, Calif. 96067

[21] Appl. No.: 60,052

[22] Filed: May 13, 1993

[51] Int. Cl.[5] ..... F02B 57/06

[52] U.S. Cl. ..... 123/43 AA

[58] Field of Search ..... 123/43 A, 43 AA, 41.73, 123/51 B; 91/501

[56] References Cited

U.S. PATENT DOCUMENTS

| | | | |
|---|---|---|---|
| 1,033,701 | 7/1912 | Iochum . | |
| 1,313,569 | 8/1919 | Wilks et al. | 123/43 AA |
| 1,389,873 | 9/1921 | Hult | 123/43 AA |
| 1,987,699 | 1/1935 | Moore | 123/43 AA |
| 2,305,475 | 12/1942 | Jagersberger et al. | 1234/41.73 |
| 3,071,122 | 1/1963 | Lieberherr | 123/51 B |
| 3,968,776 | 7/1976 | Rund | 123/43 C |
| 4,022,168 | 5/1977 | Sprague | 123/43 A |
| 4,177,771 | 12/1979 | Nutku | 123/43 C |
| 4,779,579 | 10/1988 | Sukava et al. | 123/43 A |

FOREIGN PATENT DOCUMENTS

| | | | |
|---|---|---|---|
| 484691 | 8/1917 | France | 123/43 AA |

*Primary Examiner*—Michael Koczo

*Attorney, Agent, or Firm*—Jacobson, Price, Holman & Stern

[57] ABSTRACT

A two-cycle, reciprocal piston, rotary combustion engine is provided including an outer casing, a housing disposed within and journaled from the casing about a central longitudinal axis with the housing including a plurality of parallel circularly arranged elongated cylinders spaced about the casing longitudinal axis. A pair of pistons are inversely reciprocal in each of the cylinders and the opposite ends of the casing includes stationary circular cam ramps with which rollers journaled from the remote ends of the pistons are rollingly engaged, the cam ramps and roller peripheries being inclined relative to a plane normal to the casing longitudinal axis an amount which enables the roller peripheries to rollingly contact the cam ramps substantially independent of any sliding contact between the contacting surfaces of the rollers and cam ramps, each of the longitudinal central portions of the cylinders including a single ingress and egress port opening outwardly therefrom away from the longitudinal axis of the casing successively registerable with ignition structure and combustion gas exhaust and air intake ports spaced about the casing periphery.

16 Claims, 5 Drawing Sheets

TWO-CYCLE, ROTARY, RECIPROCATING PISTON ENGINE

BACKGROUND OF THE INVENTION

1. Field of the Invention

This invention relates to a barrel-shaped engine including a plurality of parallel cylinders mounted together for rotation about a central axis within a surrounding casing. Each of the cylinders has a pair of inverse reciprocable pistons disposed therein and cam ramps are stationarily supported from the ends of the casing, face toward each other and rollers are journaled from the pistons and rollingly engaged with the cam ramps. Further, means is provided for admitting a combustible mixture into and the egress of exhaust gases from the longitudinal central portions of the cylinders in timed sequence with reciprocation of the pistons therein.

2. Description of Related Art

Various different forms of rotary engines including some of the general structural and operational features of the instant invention heretofore have been provided such as those disclosed in U.S. Pat. Nos. 1,033,701, 3,968,776, 4,022,168, 4,177,771 and 4,779,579. However, the engines disclosed in these prior art references do not include the overall combination of structural and operational features of the instant invention.

SUMMARY OF THE INVENTION

The engine of the instant invention comprises a two cycle engine which may be used as an ignition fired gasoline two cycle engine or as a diesel fueled engine independent of an ignition system.

The engine incorporates a skeletal arrangement of circularly arranged elongated cylinders within an outer casing and spaced equally about a central axis of rotation and each of the cylinders has a pair of inverse reciprocal pistons disposed therein having rollers journaled therefrom in the usual location of wrist pins and rollingly engaged with stationary circular cam ramps at the opposite ends of the engine. In addition, partly to overcome centrifugal forces acting upon the pistons and also to key the pistons within the cylinders against rotation therein, those side walls of the skirt areas of the pistons which face outwardly of the axis of rotation of the skeletal cylinder structure are provided with partial cylindrical tracks extending longitudinally therealong opposed by outer partial cylindrical tracks formed as a part of the outer casing and at least one spherical bearing member is tightly rollingly engaged between each pair of partial cylindrical tracks, the opposite ends of the outer tracks including resilient cushioning members engageable by the corresponding bearings as they reach their extremes of reciprocal movement equal to substantially one half the stroke of the corresponding pistons.

Each of the cylinders includes a port opening outwardly from the longitudinal midportion thereof comprising a combined inlet and exhaust port and the stationary casing is equipped with pressurized intake plenum and exhaust plenum structures spaced thereabout with which the exhaust ports are successively registerable for admitting a combustible mixture into each cylinder between the pistons thereof and exhausting exhaust gases from between each pair of pistons in timed sequence with reciprocation thereof. Further, the intake plenum also includes structure for purging each cylinder of the remnants of exhaust gases at the end of the exhaust stroke and at the beginning of the intake stroke and cooling of the central portions of the cylinders is effected by spray discharging coolant on the exterior thereof while lubrication of the cylinders is carried out at the opposite end portions thereof within opposite end cavities of the casing sealed from a central annular cavity of the casing in which the spray cooling of the exteriors of the cylinders occurs.

The main object of this invention is to provide a rotary, barrel-shaped two-cycle engine which will be capable of operating at high efficiency and independent of the use of fuel having lubricating oil mixed therewith.

Another object of this invention is to provide an engine in accordance with the preceding object which will be capable of developing considerable amounts of horsepower and torque while operating at relatively slow engine speeds while propelling vehicles at cruising speeds.

Another very important object of this invention is to provide an engine which is devoid or cylinder heads and utilizes opposing pistons and individual cylinders, all contained within an outer surrounding casing, to thereby limit thermal loses and to raise the efficiency of the engine to uncommon levels.

A further object of this invention is to provide an engine in accordance with the preceding objects and including a precision form of cooling system whereby only excessive detrimental heat may be absorbed in an effort to retain a large percentage of the heat of combustion within the engine to thereby further increase the efficiency.

Another important object of this invention is to provide an engine in accordance with the preceding objects and wherein the rolling contact surfaces of the cam track and the piston rollers are inclined such that rolling movement of the rollers along the track will be substantially free of any sliding movement between the contacting surfaces.

A further object of this invention is to provide an exhaust system which will be capable of separately exhausting the initial high pressure exhaust gases and subsequently exhausting the lower pressure exhaust gases from the cylinders whereby the separate high and low pressure exhaust gases may be more efficiently utilized to drive a turbine to in turn provide power for a supercharger or turbo charger for supplying the intake plenum with intake air under pressure.

A final object of this invention to be specifically enumerated herein is to provide a rotary engine in accordance with the preceding objects and which will conform to conventional forms of manufacture, be of simple construction and easy to service so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
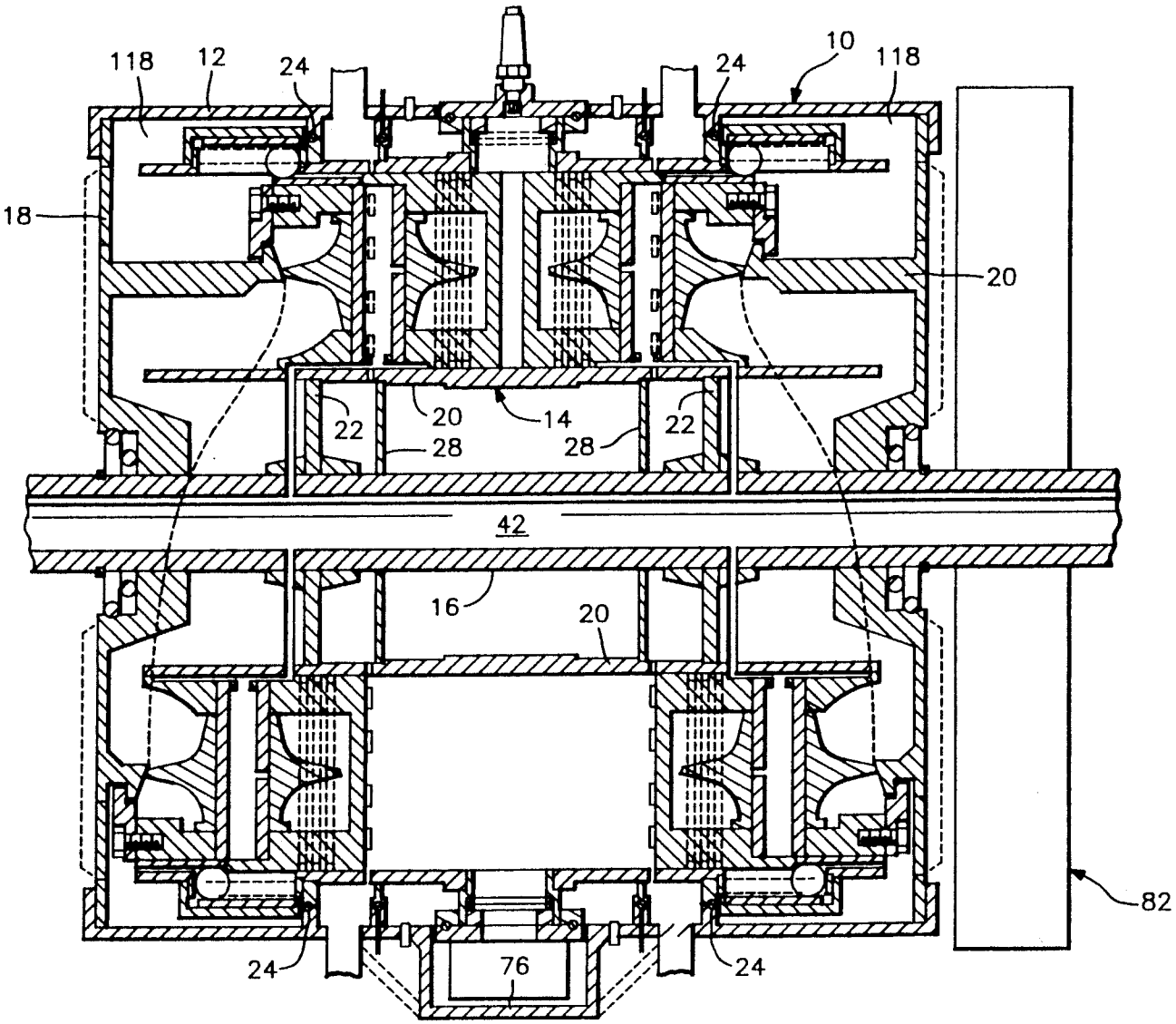
FIG. 1 is a fragmentary longitudinal sectional view of the engine with one set of pistons thereof illustrated at their maximum compression positions and another set of pistons illustrated at their full exhaust position.

Referring now more specifically to the drawings and to FIGS. 1–4 in particular, the reference numeral 10 generally designates the engine of the instant invention which includes an outer stationary casing 12 and an inner skeletal cylinder assembly referred to in general by the reference numeral 14. The assembly 14 is mounted upon a central tubular shaft 16 journaled lengthwise through the casing 12 and the latter includes removable end walls 18 and 20.

Figure 2:
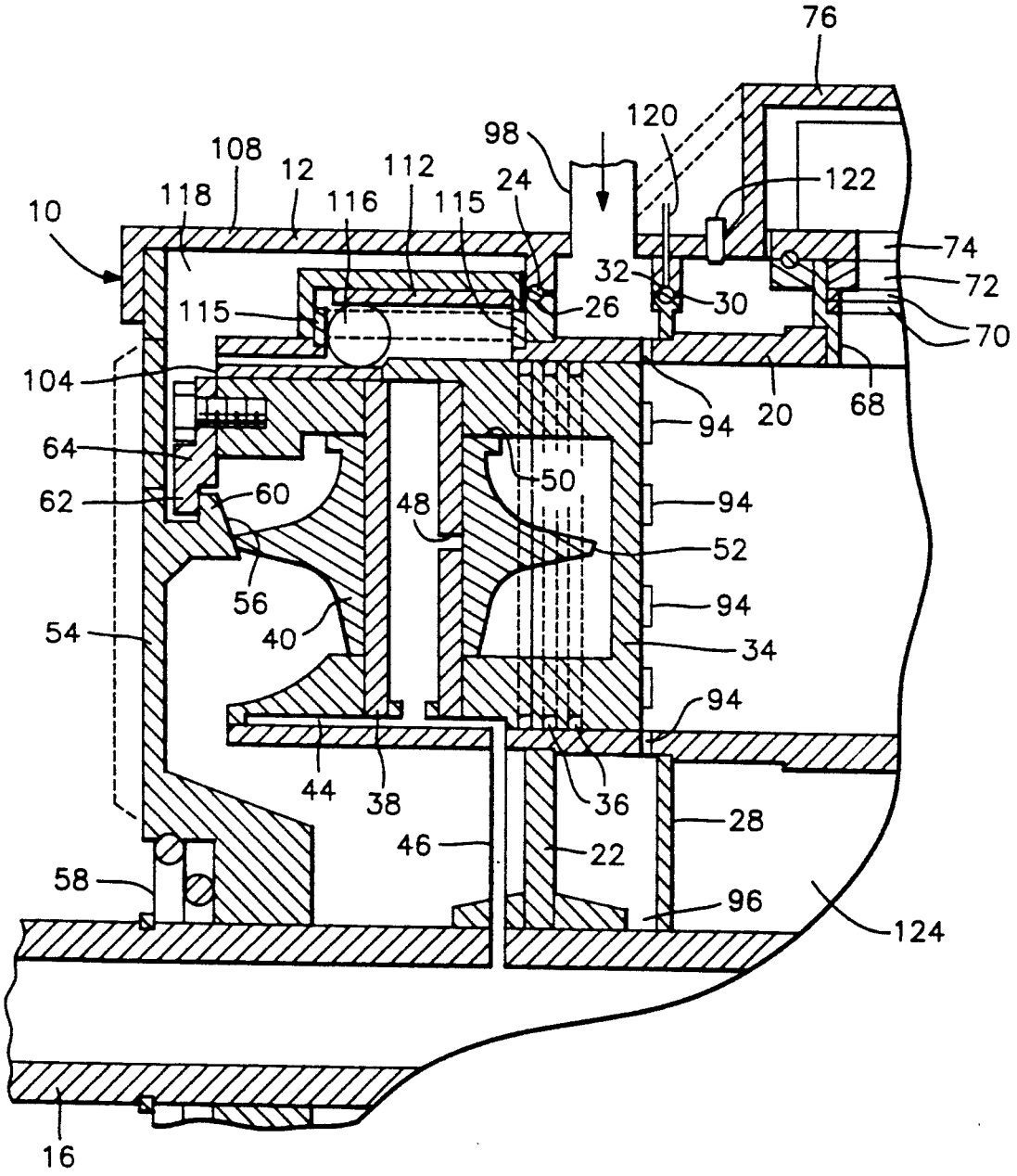
FIG. 2 is a fragmentary vertical sectional view illustrating only one of the cylinders of the engine and its attendant intake and exhaust port and the manner in which that cylinder may be exhausted of combustion gases and purged of exhaust gases.
Figure 4:
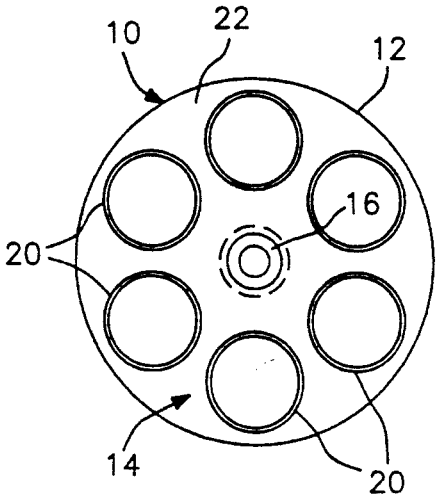
FIG. 4 is a reduced schematic end view illustrating the positional relationship of the six cylinders of the engine in relation to the center axis of the rotating parts thereof.
Figure 5:
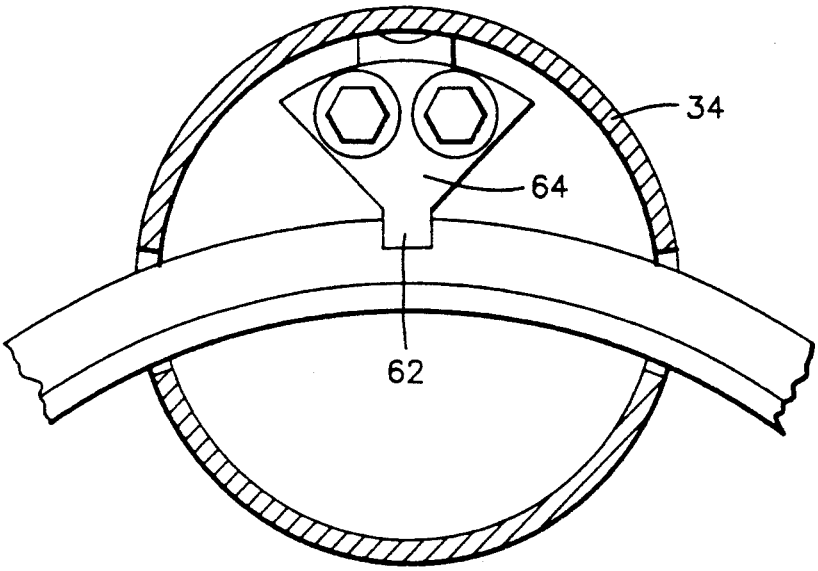
FIG. 5 is an enlarged fragmentary cross sectional view of one of the cylinder ends illustrating the attendant piston attached follower for engagement with the outer side of the corresponding cam track.

As may be seen from FIG. 4 of the drawings, the skeletal assembly 14 includes six parallel cylinders 20 equally spaced about and outward from the shaft 16, the cylinders 20 being rigidly mounted from the shaft 16 through the utilization of apertured annular mounting plates 22 sealed relative to the shaft 16 and whose outer peripheries are rotatably sealed relative to the casing 12 as at 24 through the utilization of O-ring seals 26, see FIG. 2.

In addition, secondary partitions 28 are provided and support the cylinders 20 from the shaft 16, the partitions 28 being sealed relative to the casing 12 as at 30 through the utilization of O-ring seals 32.

Each of the cylinders 20 has a pair of opposing inversely reciprocable pistons 34 slidably received therein equipped with piston rings 36 and, in the usual location of a piston wrist pin, a journal shaft 38 is provided upon which a cam follower roller 40 is journaled. The interior of the shaft 16 is charged with lubricating oil 42 under pressure and the adjacent side of each piston 34 is relieved as at 44 and an oil tube 46 opens outwardly of the tubular shaft 16 and into each end of each cylinder 20 in registry with the relieved area 44 of the corresponding piston (see FIG. 2), the adjacent end of the tubular journal shaft 38 being open for receiving oil therein and each journal shaft 38 including a radial bore 48 for lubricating the relatively rotatable surfaces of the journal shafts 38 and the rollers 40.

The outer axial ends 50 of the rollers 40 comprise thrust bearing surfaces which are also lubricated through the radial bores 48 and each roller 40 includes a frustoconical outer peripheral and hardened surface 52 disposed at a predetermined angle to be hereinafter more fully set forth. In addition, each end wall 18 and 20 of the casing 12 includes a center section 54 from which a circular cam ramp 56 is supported, each cam ramp 56 also defining a frustoconical and hardened surface disposed at the same angle as the surfaces 52. Of course, the center section 54 is sealed relative to the tubular shaft 16 through the utilization of suitable seals 58, see FIG. 2.

In addition, each of the cam ramps 56 includes a lip 60 behind which a tongue 62 carried by a mount 64 removably secured to each piston 34 is engaged, there being a slight clearance between each tongue 62 and it's lip 60 when the corresponding roller 40 is engaged with the cam ramp 56.

Figure 3:
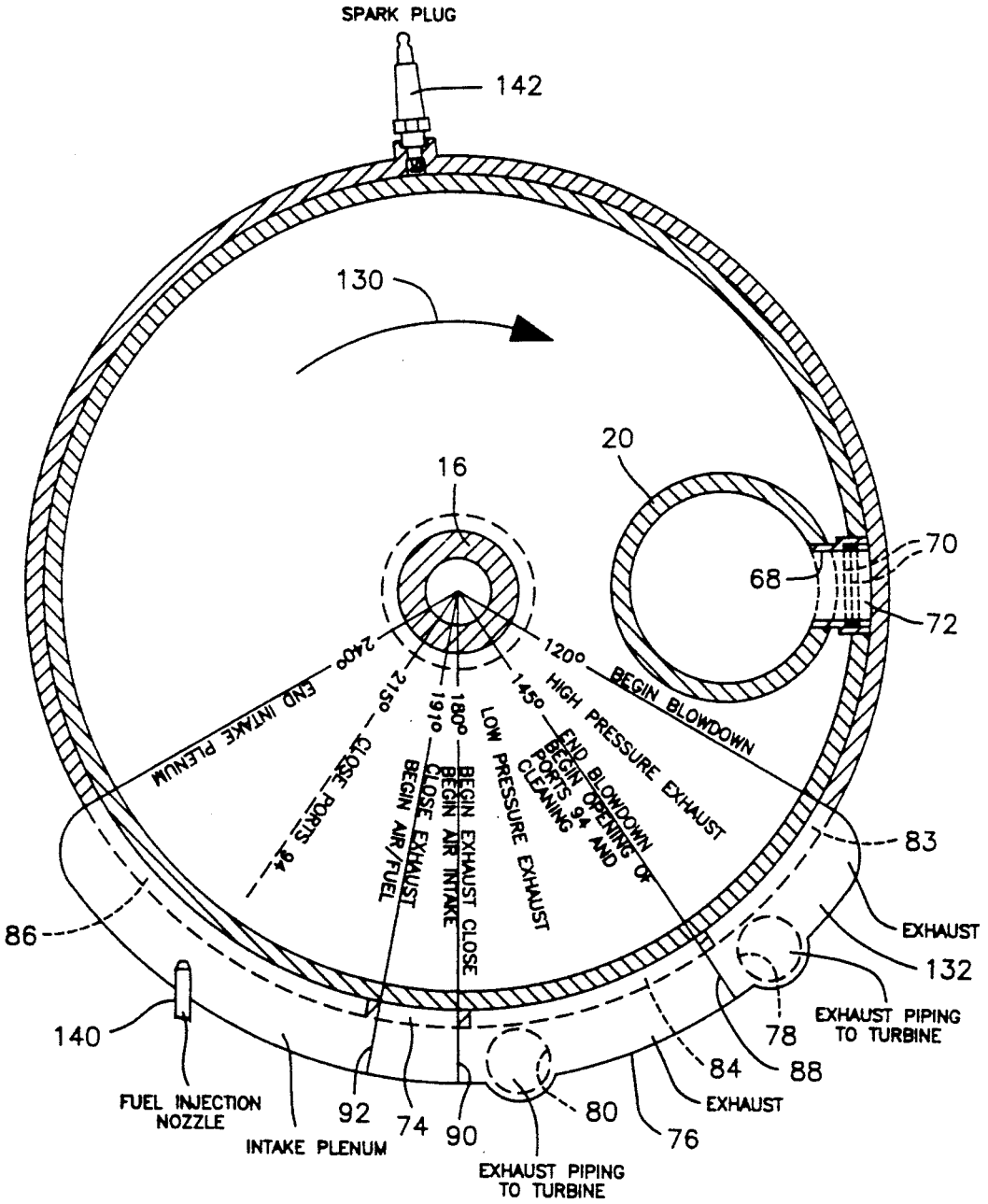
FIG. 3 is a schematic cross sectional view of the engine illustrating only one of the cylinders thereof and the manner in which that cylinder may successively undergo initial high pressure exhaust, low pressure exhaust and purging of exhaust gases therefrom, intake of a fresh air charge, fuel injection and ignition after compression.

With attention now invited more specifically to FIGS. 1, 2 and 3 of the drawings, it may be seen that each cylinder 20 includes a longitudinal midportion combined inlet and outlet port 68 which opens radially outwardly away from the tubular shaft 16 and which supports two rings 70 and an annular seal 72, the rings 70 and the seal 72 being slidably received in the outer portion of the port 68 with the seal 72 bearing with lubrication against the inner cylindrical surface of the casing 12 about a port 74 therein, the port 74 being one of several ports opening inwardly from a plenum 76 including primary high pressure exhaust piping 78 and secondary low pressure exhaust piping 80 for ducting exhaust gases to a combined exhaust turbine and air compressor referred to in general by the reference numeral 82, see FIG. 1. The exhaust turbine and air compressor may input power directly to the tubular shaft 16 and also serve to compress air to be admitted into the cylinders 20 through port 74.

The plenum 76 additionally includes a port 83 with which the port 68 is registerable in order to exhaust initial high pressure exhaust gases from the cylinder 20 and a port 84 with which the port 68 is subsequentally registered in order to exhaust secondary low pressure exhaust to the exhaust piping 80. Finally, the plenum 76 includes a port 86 with which the port 68 is registerable subsequent to the port 74 for admitting a charge of air under pressure into the cylinder 20, the port 83 being partitioned from the port 84 as at 88, the port 84 being partitioned from the port 74 as at 90 and the port 74 being partitioned from the port 86 as at 92, see FIG. 3.

The cylinders 20 each have circumferentially spaced inlet ports 94 opening thereinto from an inlet cavity 96 (see FIG. 2) disposed between the partitions 22 and 28 to which air under pressure is supplied by piping 98 from the air compressor 82. The ports 94 are uncovered only as the pistons 34 in each cylinder 20 approach their limit positions of movement away from each other.

Figure 6:
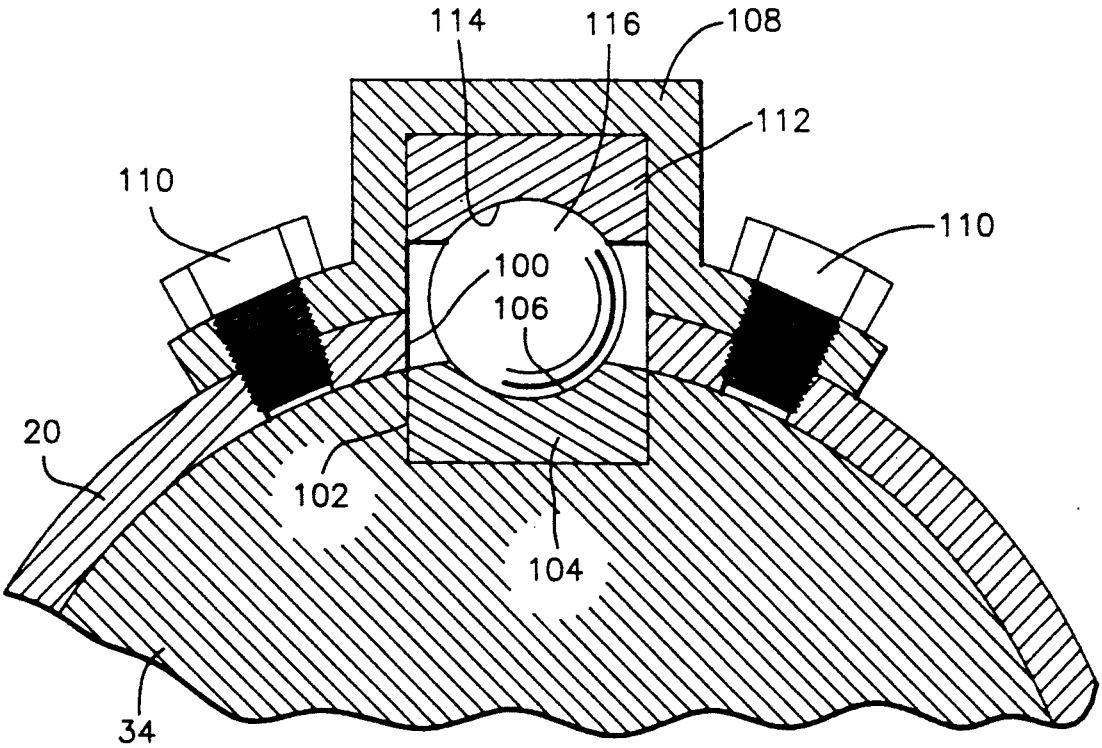
FIG. 6 is an enlarged fragmentary transverse sectional view illustrating the manner in which the outer sides of the pistons and outer portions of the rotary assembly include spherical bearing means therebetween for counteracting centrifugal forces acting upon the pistons.

The opposite ends of each cylinder 20 include slots 100 formed therein opening radially outwardly away from the tubular shaft 16 and the pistons 20 include grooves 102 registered with the slots 100 and bearing race blocks 104 having semicylindrical grooves formed therein are secured within the grooves 102 (see FIG. 6). In addition, the cylinders 20 have channel shaped housings 108 removably secured thereto in registry with the slots 100 through the utilization of removable fasteners 110 and the housings 108 include bearing race blocks 112 secured therein also equipped with semicylindrical grooves 114, at least one spherical bearing member 116 being tightly disposed between each pair of opposing grooves 104 and 114 and the housings 108 further include resilient stops 115 (see FIG. 2) for cushioning termination of movement of the bearing members 116 toward and away from the remote axial ends of the engine 10. The spherical bearing members not only serve to maintain the pistons 34 against rotation in the cylinders 20, but also to take up the side thrust developed upon the pistons 34 by the inclined surfaces of the cam ramp 56 and the rollers 40. Still further, the spherical bearing members also sere to take up most centrifugal forces acting upon the pistons 34 during rotation of the skeletal cylinder assembly 14. Thus, the spherical bearing members 116 serve three different purposes.

The opposite end cavities 118 of the casing 12 have oil spray and mist therein as a result of oil being ducted through the piping 46 and the journal sleeves 38 and, thus, the bearing race blocks 104 and 112 as well as the spherical bearing members 116 are adequately lubricated. In addition, the O-ring seals at 26 are lubricated in the same manner while the O-ring seals 32 receive low pressure lubrication through oil lines 120, see FIG. 2.

In order to cool the cylinders 20, the casing 12 includes a double row of circumferentially spaced water spray heads 122 disposed thereabout for sprayed discharging cooling water onto the longitudinal midportions of the cylinders 20 between the partitions 28. The central cavity 124 of the interior of the casing 12 disposed between the partitions 28 may have a suitable drain (not shown) for draining cooling water or liquid gravitating theretoward and communicated with duct means (not shown) for ducting the heated water and steam or water vapor to a condenser (radiator).

It also will be noted that oil pump means (not shown) may be communicated with lower drain means in the end cavities 118 for collecting lubricating oil gravitating theretoward and returning the lubricating oil to the interior of the tubular shaft 16 under pressure.

Still further, the ports or slots 94 may be inclined, if desired, in order to create a swirling action within the cylinders during the process of purging remaining exhaust gases therefrom.

Figure 7:
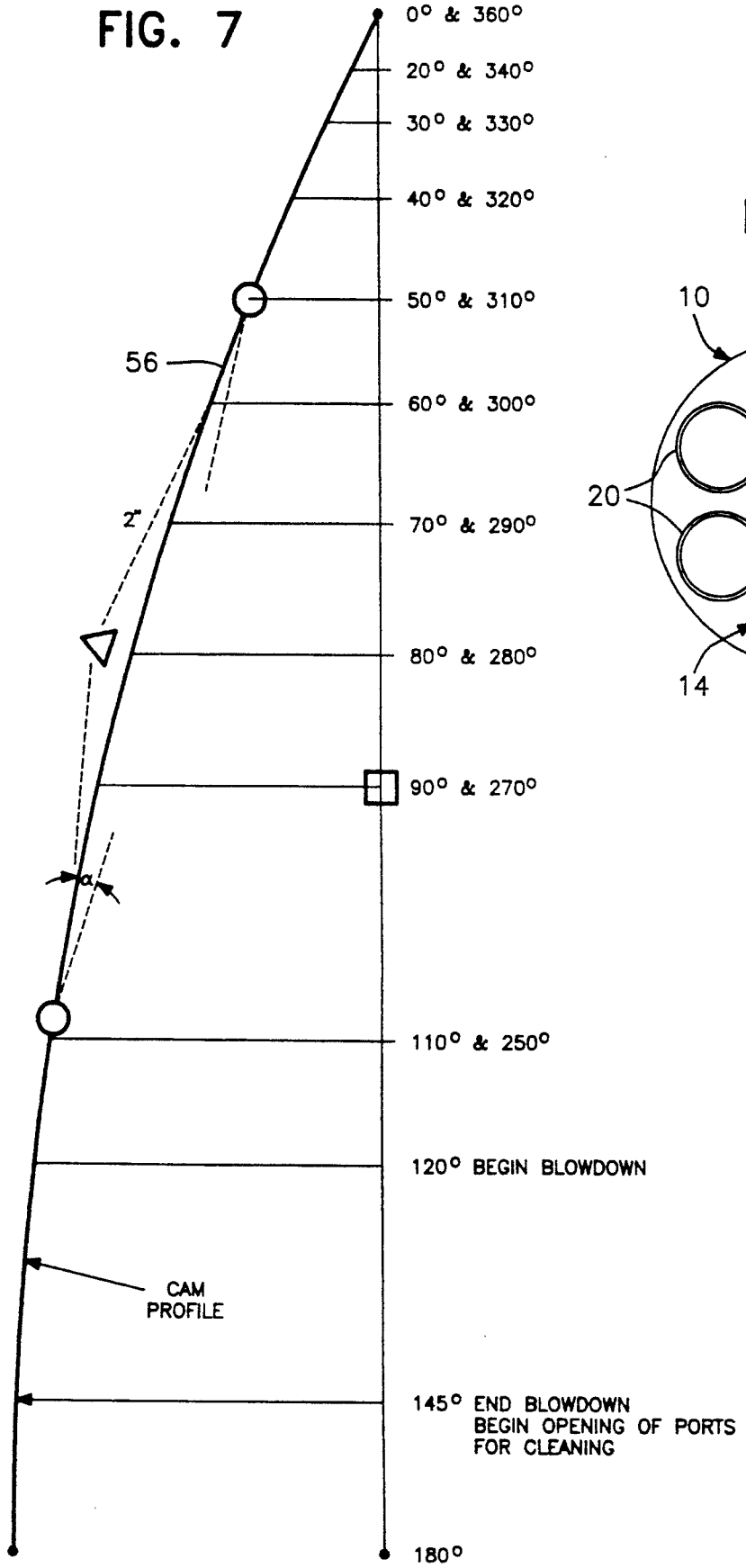
FIG. 7 is a diagrammatic view illustrating the cam profile in relation to 180° of rotation of the rotary components of the engine clearly illustrating the power stroke before exhaust occurring through generally 120° of rotation, exhaust and intake procedures being carried out through generally the next 120° of rotation and the compression stroke being carried out during generally the last 120° of rotation before ignition.

FIG. 7 represents a typical linear profile of 180° of the cam ramp or track 56. It will be noted that about 90% of the piston displacement occurs in generally 120° of rotation of the shaft 16 and allows about 120° of shaft rotation for exhaust and intake. Further, the same port 68 is used for both exhaust and intake and, accordingly, each time the exhaust port is heated as a result of exhausting combustion gases from the cylinders 20, it is subsequently cooled by the entrance of fresh air therethrough into the cylinders 20.

Assuming that the width of the rim or periphery of the roller 40 is 1/10 of an inch and that the diameter of the cam ramp or track 56 at the central point of contact of the rollers 40 therewith is 8 inches, the cam track center line is $2\pi 4$ in circumference and the outside edge distance of the area of contact is $2\pi 4.05$.

If "n" represents the degrees of rotation of the wheel then the ratio and proportion will solve for the angle required to make an even distance traveled when "n" is constant. In this situation it may be assumed that the radius of the center of the wheel rim is 1.45 inches. Let l=extra distance rolled because of ramp variation. Then if l=2 inches, for example, $$\text{Then} \quad \frac{2\pi 4'' + l}{2\pi 1.45'' n} =$$

$$\frac{2\pi 4.050'' + l}{2\pi r n} \quad \frac{\text{Tan}\ \theta = 1.4668 + '' - 1.45''}{.05''} = .33578$$

$$r = 1.466789 \text{ inches} \qquad \theta = 18.561 \text{ degrees}$$

From the above, it therefore may be seen that the angle of the cam ramp and the outer rim 52 of the roller 40 will be 19.926° in order to allow rolling contact of the rim of the roller 90 with the cam ramp 56 substantially independent of any sliding contact between the wheel rim or periphery 52 and the cam ramp 56.

With attention now invited more specifically to FIG. 3 of the drawings and the arrow 130 thereon, it may be seen that the port 68 of a cylinder 20 on the power stroke will first register with the port 83 in the first partitioned section 132 of the plenum 76. At this point exhaust gases under high pressure are discharged through the ports 68 and 83 and into the high pressure exhaust piping 78 to the turbine 83. Thereafter, the port 68 registers with the low pressure exhaust port 84, the port 82 begins to close and the slots or ports 94 begin to uncover in order that pressurized air may be admitted into the cylinder 20 by the piping 98 in order to purge substantially all of the remaining exhaust gases from the cylinder 20. Thereafter, the exhaust port 68 begins to move out of registry with the port 84 and into registry with the port 74 in order to intake air into the cylinders 20. Subsequentally, the port 68 moves into full registry with the port 74 thereby fully closing the exhaust port 84. Finally the port 68 moves into registry with the port 86, during which registry additional air under pressure is admitted into the cylinder 20, and at approximately 215° of rotation the ports 94 are closed and air intake continues until approximately 240° of rotation, each cylinder, in succession, being provided with fuel injection from nozzle 140 into the cylinder 20, the fuel injection timing may occur anywhere between or fully throughout 191° of rotation and 240° of rotation. Thereafter, as the cylinder 20 moves past 240° of rotation and continues to have the pistons therein move toward their closest positions illustrated in the upper portion of FIG. 1, the port 68 registers with the spark plug 142 which supplies ignition for the combustible air and fuel mixture under compression between the two pistons 34 and each cylinder 20, see FIG. 1. Of course, inasmuch as the port 68 is closed, the burning combustible mixture between the pistons 34 causes the rollers 40 thereof to move downwardly along the cam ramp 56 and thus to impart rotation to the shaft 42. As the pistons approach the remote ends of the cylinders, the successive high pressure exhaust, low pressure exhaust and exhaust gas purging operations are carried out after which fresh intake air is admitted into the port 68 and the fuel nozzle injects combustible fuel into the cylinder before the intake port 68 moves out of registry with the port 86 and the pistons 20 continue their movement toward each other during the compression stroke before the port 68 again registers with the spark plug 142.

It is to be noted that the pistons 134 may be provided with a fourth ring between the ring 36 closest to the end face of the piston and the end face, if desired. Furthermore, the turbine 82 may drive a centrifugal supercharger or a positive displacement supercharger in order to supply air under pressure to the piping 98 and the ports 74 and 86. Also, the spark plug 142 may be mounted upon an independently circumferentially shiftable portion of the casing 12, if desired, in order to enable ignition timing to be varied.

Further, the profile of the cam ramp 56 may be varied as desired according to the specific desired performance characteristics of a particular engine. As an example, the cam ramps 56 may be constructed such that the pistons 34 in each cylinder 20 may remain motionless at their closest positions throughout generally 20 degrees of rotation of the shaft 16, thereby allowing for varied ignition timing according to desired speed of operation of the engine and type of fuel being used.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A rotary reciprocal piston machine including housing means having circularly arranged parallel, elongated cylinders, a pair of inversely reciprocal pistons slidably received in the opposite end portions of each of said cylinders, a pair of circular cam ramps disposed at opposite ends of said cylinders each facing toward the remote end, said pistons each journaling a cam follower roller therefrom rollingly engaged with the corresponding cam ramp, said cylinders each being connected to central journaled shaft means about which said cylinders are spatially arranged, said cam ramps and pistons also including coacting guide and follower means limiting movement of said pistons toward the longitudinal centers of said cylinders in excess of a predetermined amount greater than that caused by said cam ramps and rollers, and ingress and egress means for ingress and egress of fluids into and out of said cylinders between the pistons therein in timed relation with reciprocation of said pistons in said cylinders, said machine comprising a two-stroke combustion engine and said ingress means including means for admitting a combustible mixture of fuel and air into each of said cylinders from radially outwardly of the circle arrangement of said cylinders as the pistons therein are disposed substantially at their greatest distance apart, ignition means for igniting said fuel and air mixture in each of said cylinders as said pistons are disposed substantially at their closest spaced relation, said egress means including means for exhausting gases as said pistons approach their greatest distance apart, said engine including cylinder purging means operative to purge each of said cylinders of exhaust gases with fresh air subsequent to operation of said egress means and before operation of said ingress means, said egress means including means operative to exhaust spent gases from said cylinders generally radially outwardly of said circle arrangement, and said purging means including means operative to simultaneously introduce purging air into said cylinders from radially outwardly of said circle arrangement and exhaust residue spent gasses and purging air from said cylinders generally radially outwardly of said circle arrangement.

2. The machine of claim 1 wherein said housing means is disposed within said journaled from an outer casing, said ingress and egress means including a longitudinally centrally located first port opening radially outwardly of each of said cylinders and the circle arrangement of said cylinders, said casing including circumferentially extending and spaced intake and exhaust plenum port means spaced about said circle arrangement and having intake and exhaust, respectively, ports opening radially inwardly toward the axis of rotation of said shaft means and with which said first ports are successively registerable, said exhaust plenum means being adapted to duct exhaust gases therethrough to an exhaust gas powered turbine and said intake plenum being adapted to receive air under pressure from a compressor driven from said turbine, and ignition means carried by said housing with which each of said first ports are registerable subsequent to being registered with said egress and ingress ports during rotation of said housing relative to said casing.

3. The machine of claim 2 wherein said first ports open outwardly through a cylindrical surface of said housing opposed by a lubricated cylindrical area of said casing through which said intake and exhaust plenum port means open.

4. The machine of claim 2 wherein said first ports each includes centrifugal force responsive seal means operative to effect a seal with said cylindrical area and operative to increase the effectiveness of said seal as the speed of rotation of said housing means relative to said casing increases.

5. The machine of claim 2 wherein said housing means is mounted upon said shaft and the latter is journaled through said casing.

6. The machine of claim 5 wherein said shaft is hollow and charged with lubricating oil under pressure, and oil passage means communicating the interior of said shaft with the interiors of said cylinders at the remote ends thereof.

7. The machine of claim 5 wherein said cam follower rollers are journaled from diametric pins supported from said pistons, said shaft being hollow and charged with lubricating oil under pressure, and oil passage means communicating the interior of said shaft with the journal surfaces of said pins and rollers.

8. A rotary reciprocal piston machine including housing means having circularly arranged parallel, elongated cylinders, a pair of inversely reciprocal pistons slidably received in the opposite end portions of each of said cylinders, a pair of circular cam ramps disposed at opposite ends of said cylinders each facing toward the remote end, said pistons each journaling a cam follower roller therefrom rollingly engaged with the corresponding cam ramp, said cylinders each being connected to central journaled shaft means about which said cylinders are spatially arranged, said cam ramps and pistons also including coacting guide and follower means limiting movement of said pistons toward the longitudinal centers of said cylinders in excess of a predetermined amount greater than that caused by said cam ramps and rollers, and ingress and egress means for ingress and egress of fluids into and out of said cylinders between the pistons wherein in timed relation with reciprocation of said pistons in sad cylinders, each pair of said pistons including remote skirt portions, the areas of said skirt portions facing outwardly from said central shaft means including inner, outwardly opening partially cylindrical surfaces extending therealong, said housing means including outer, inwardly opening partial cylindrical surfaces extending therealong opposing said inner partial cylindrical surfaces, and spherical bearing means disposed between pair of opposing inner and outer partial cylindrical surfaces in tight rolling contact therewith.

9. The machine of claim 8 wherein the opposite ends of said outer partial cylindrical surfaces have resilient stop means operatively associated therewith for abutment by the corresponding spherical bearing means, the stroke of said pistons as defined by said cam ramps and guide and follower means being slightly greater than twice the travel distance of said bearing means between said resilient stop means.

10. The machine of claim 9 including cooling means for said cylinders, said casing defining annular cavities therein concentric with the axis of rotation of said housing relative to said casing, major portions of the longitudinal central portions of said cylinders including external surfaces thereof disposed within said cavities, at least one of said cavities including cooling liquids spray jet means therein supported from said casing operative to spray cooling liquid on at least some of said external surfaces.

11. The machine of claim 10 wherein said housing means is mounted upon said shaft means and the latter is journaled through said casing, said shaft means being hollow and charged with lubricating oil under pressure, oil passage means communicating the interior of said shaft with the interiors of said cylinders at the remote ends thereof, said cavities including partition means closing off the opposite end portions thereof from the central portions thereof, said some of said internal surfaces being disposed in said central portions of said cavities, said opposite end portions of said cavities comprising lubricating oil liquid and vapor collection cavities adapted to have liquid lubricating oil withdrawn therefrom for pressurizing and reintroduction into the interior of said shaft.

12. A two-cycle, reciprocal piston, rotary internal combustion engine including an outer casing, a housing disposed within and journaled from said casing about a central longitudinal axis, said housing including a plurality of parallel circularly arranged elongated cylinders spaced about said axis, a pair of pistons inversely reciprocal in each of said cylinders, means connected between said pistons and casing for inversely reciprocating said pistons responsive to relative rotation between said casing and housing, said cylinders each including longitudinal midportion port means opening outwardly therefrom away from said axis, said casing including exhaust and intake plenum means opening inwardly toward said axis and with which each of said port means is successively registerable, each pair of said pistons including remote skirt portions, the areas of said skirt portions facing outward from said axis including inner, outwardly opening partial cylindrical surfaces extending therealong, said housing means including outer, inwardly opening partial cylindrical surfaces extending therealong opposing said inner partial cylindrical surfaces, and spherical bearing means disposed between each pair of opposing inner and outer partial cylindrical surfaces in tight rolling contact therewith.

13. The engine of claim 12 wherein the opposite ends of said outer partial cylindrical surfaces have resilient stop means operatively associated therewith for abutment by the corresponding spherical bearing means, the stroke of said pistons being slightly greater than twice the travel distance of said bearing means between said resilient stop means.

14. The engine of claim 13 including cooling means for said cylinders, said casing defining annular cavities therein concentric with the axis of rotation of said housing relative to said casing, major portions of the longitudinal central portions of said cylinders including external surfaces thereof disposed within said cavities, at least one of said cavities including cooling liquid spray jet means therein supported from said casing operative to spray cooling liquid on at least some of said external surfaces.

15. The engine of claim 14 wherein said housing means is mounted upon said shaft means and the latter is journaled through said casing, said shaft means being hollow and charged with lubricating oil under pressure, oil passage means communicating the interior of said shaft with the interiors of said cylinders at the remote ends thereof, said cavities including partition means closing off the opposite end portions thereof from the central portions thereof, said some of said internal surfaces being disposed in said central portions of said cavities, said opposite end portions of said cavities comprising lubricating oil liquid and vapor collection cavities adapted to have liquid lubricating oil withdrawn therefrom for pressurizing and reintroduction into the interior of said shaft.

16. The engine of claim 12 including cooling means for said cylinders, said casing defining annular cavities therein concentric with the axis of rotation of said housing relative to said casing, major portions of the longitudinal central portions of said cylinders including external surfaces thereof disposed within said cavities, at least one of said cavities including cooling liquids spray jet means therein supported from said casing operative to spray cooling liquid on at least some of said external surfaces.

* * * * *